United States Patent [19]

De Tarr

[11] 4,253,350

[45] Mar. 3, 1981

[54] GARAGE DOOR SPRING TENSIONING APPARATUS

[76] Inventor: Vincent De Tarr, P.O. Box 8257, South Lake Tahoe, Calif. 95731

[21] Appl. No.: 4,079

[22] Filed: Jan. 17, 1979

[51] Int. Cl.[3] ..... B25B 13/48

[52] U.S. Cl. ..... 81/3 R; 81/62

[58] Field of Search ..... 29/227, 240; 81/3 R, 81/62, 63.2, 90 B, 90 C

[56] References Cited

U.S. PATENT DOCUMENTS

| | | | |
|---|---|---|---|
| 2,578,686 | 12/1951 | Fish | 81/62 |
| 2,982,162 | 5/1961 | Golden | 81/90 B;90 C |
| 3,651,719 | 3/1972 | Wessel | 81/3 R X |
| 3,979,977 | 9/1976 | Dorma | 81/90 C X |

*Primary Examiner*—James G. Smith
*Attorney, Agent, or Firm*—Herbert C. Schulze

[57] ABSTRACT

This invention is a spring tensioning device for applying proper tension to springs utilized widely in garage doors, and the like. The device consists of a collar which can be slipped over a rod around which such spring is wound, which device is fitted with a pair of ratcheting mechanisms and a device to hold the same in place while the ratchets are used. Additionally, the apparatus has boss means for hooking into the spring collar for applying the correct tension through the use of the ratcheting arrangement. Additionally, the apparatus has means for attaching to a collar fastened to one end of the spring in order to turn the collar and, thus, the spring through the use of the ratcheting mechanism.

4 Claims, 6 Drawing Figures

GARAGE DOOR SPRING TENSIONING APPARATUS

CROSS-REFERENCE TO RELATED PATENT APPLICATIONS

There are no other patent applications filed by me related to this patent application.

BACKGROUND OF THE INVENTION

1. Field of the Invention

This invention is in the general field of spring tensioning apparatus and is more particularly directed to the tensioning of springs utilized in connection with garage door openers, and is even more particularly directed to a hand ratchet operated tensioning device for applying proper tension to a coil spring as utilized in garage doors, and the like.

2. Description of the Prior Art

The prior art in this field is limited to the use of rods, bars, wrenches, and the like, for gripping in some manner and tensioning a collar about the end of the spring being tensioned and to one, heretofore devised, power operated winding device known as the "PowRench" as manufactured by Dorsizer International, Inc., of Minneapolis, Minn.

Neither the prior hand method nor the powered device mentioned accomplish the ends desired, and neither one incorporates the use of a pair of ratcheting devices detachably latched onto the rod around which the spring is wound and having means to connect to the spring collar for applying tension.

Thus, the present invention is totally unique in providing a safe, double ratchet, hand operated device to wind springs as is described in greater detail below.

SUMMARY OF THE INVENTION

Throughout the United States, and in other areas, the use of garage doors which are operated by motors, or the like, has grown in popularity to the point where use of the power operated doors, or as they are popularly referred to "door openers", has become very wide spread. It has become a major business with many persons involved in this occupation.

Customarily, in connection with such power doors, there is a spring device (normally a coil spring wrapped around a shaft) which applies the proper tension for control of the door in opening and/or closing. This will be understood by those skilled in the art as a necessary part of the door opening mechanism. It need not be explained in detail in this application, however, since this application relates solely to the tensioning of such spring.

In the garage door installation, adjustment, and repair business, one of the most difficult and dangerous tasks for the installer is in connection with the proper tensioning of the coil spring. These springs are quite heavy and normally are wrapped about a collar which is incorporated within a flange on one end, which flange is connected to the structure. On the other end of the spring there is a collar which is loose upon the shaft, but which collar can be fastened upon the shaft by means of a set screw. One or more radial holes are provided on the edge of the collar. In properly adjusting the tension, it is customary to place a rod, or the like, within the hole, or holes, about the circumference of the collar. The collar is then turned by use of such rod slipped into such hole by the installer and is, in essence, wound about the shaft so that the spring receives the appropriate tension. This is a dangerous operation since the rods utilized frequently will slip from the hole into which they are placed and, when this happens, there can be a violent unwinding of the spring. If care is not exercised, the rod itself will have the potential of injuring the installer or flying out and doing other damage.

In the past there has been one attempt at a device to overcome the inherent danger and difficulty of the winding of the spring by hand. That device is known as the "PowRench" as manufactured by Dorsizer International, Inc., of Minneapolis, Minnesota. This device requires the use of electrical power and is quite expensive. It is also rather large, heavy, and bulky.

I have studied this field of art and have now conceived and developed a safe, hand operated, ratchet device which allows completely proper tensioning without danger to the operator and with ease of operation.

In my device, I have constructed a horseshoe-like elongated collar, having another horseshoe-like elongated collar mounted therein and suitable to turn for the purpose of providing a means to slip the device onto a shaft and lock it in position by turning the interior horseshoe device. Mounted to this device is a bracket carrying a boss suitable to engage the hole in the outer circumference in the spring collar. Also mounted on the device are a pair of ratcheting mechanisms, together with handles for the ratcheting mechanisms, whereby the entire mechanism may be rotated about the shaft from one position and wherein the installer need not pass around the shaft in tightening or loosening the spring. By the alternate use of the two ratchets from one position and with short arm strokes, the operator is enabled to properly wind the spring.

Thus, it is an object of this invention to provide a device for hand operated ratchet spring tensioning adjustment.

Another object of this apparatus is to provide a device as set forth wherein danger to a person tensioning coil springs in garage door applications is minimized.

Another object of this invention is to provide a device as heretofore set forth which can be easily slipped on and off a shaft about which a spring is wound.

The foregoing and other objects and advantages of this invention will become apparent to those skilled in the art upon reading the description of a preferred embodiment which follows, in conjunction with the appended drawings.

DESCRIPTION OF A PREFERRED EMBODIMENT

Figure 1:
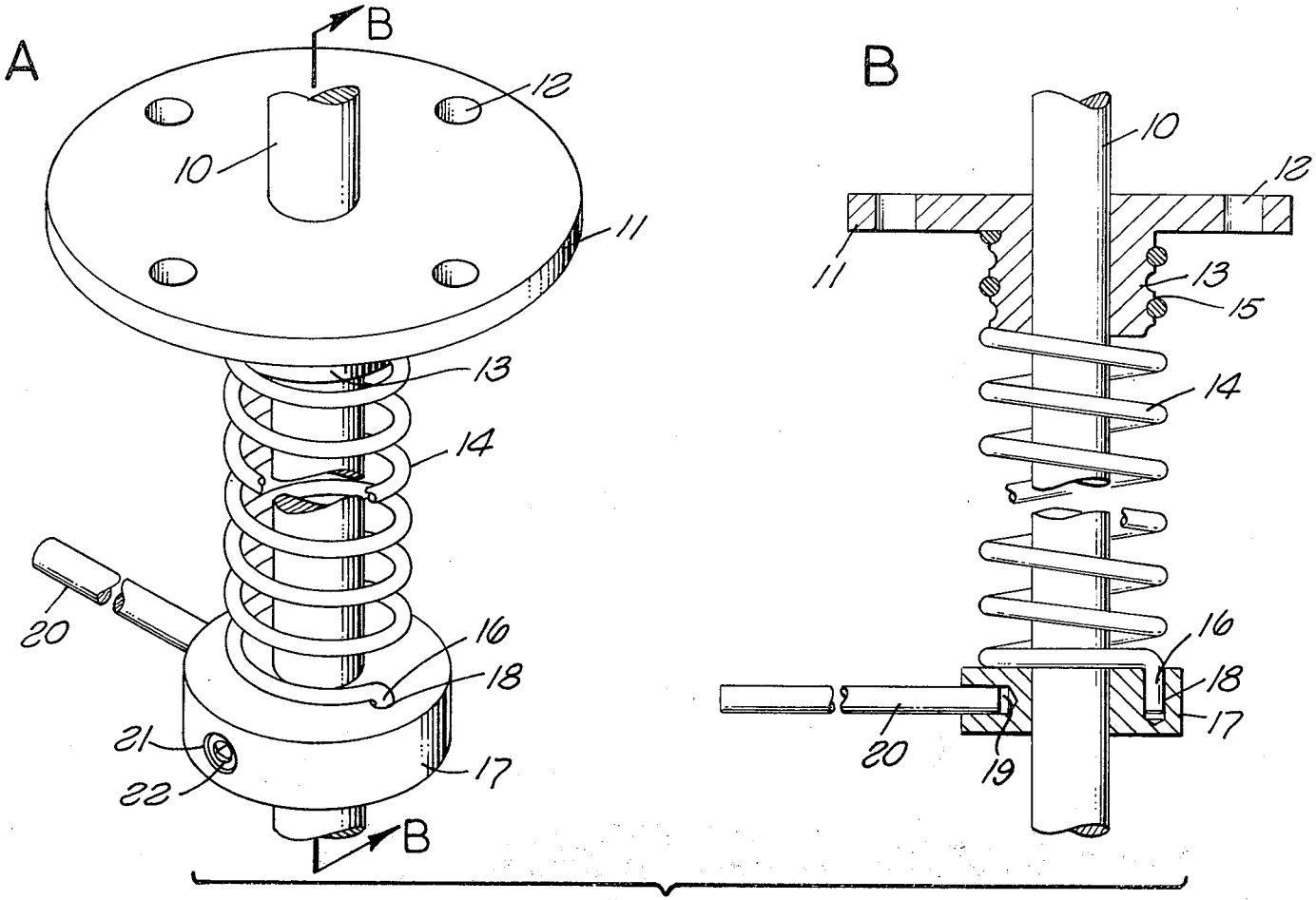
FIG. 1 PRIOR ART
FIG. 1 illustrates the prior art, with a partial perspective in 1A and a section on B—B of said perspective in 1B.

FIG. 1 illustrates the important features of a spring utilized in the tensioning of garage door openers. The shaft 10, which is used in connection with the garage door and its operations, is rotatably mounted within an opening through flange 11 and boss 13 which is shaped as at 15 to accommodate and hold certain coils of the spring 14, as is known to those skilled in the art. The flange is normally fastened to the structure by means of bolts, or the like, through holes 12 in the flange.

A collar 17 is customarily located adjacent the opposite end of the spring which normally has an end piece 16 bent as is shown in the figures and inserted within a hole 18 within the collar 17.

The collar will also normally carry a set screw 22 in a threaded hole 21.

One or more radial holes 19 will normally be provided in the collar and a rod 20, or the like, which can fit within such holes 19, is provided for tensioning purposes. In use the rod 20 will be gripped by an installer and the set screw 22 will be loosened. The collar will then be turned to apply the desired tension utilizing the handle 20 for this purpose. When the tension is correctly applied, the set screw 22 will then be fastened in position upon the shaft and, thus, will hold the desired spring tension about the shaft.

It will be clear that very large wrenches, or the like, are sometimes used for the purpose of turning the collar and, of course, the power device heretofore described can also be so used. By far the most common and generally preferred method heretofore, however, has been the use of a bar such as the bar 20.

Utilizing a bar in the hole or holes in the collar and twisting it around the shaft is dangerous as well as difficult work. Frequently, if one is not careful, the handle 20 can slip from the hand of the user or can slip from the hole. Violent unwinding which occurs because of spring tension applied can cause serious injury and, also, damage.

The preferred embodiment of the present invention is shown in FIGS. 2 through 6 which can all be studied together. Certain reference will be made, however, to certain of the figures in the description which follows for ease of understanding.

Figure 2:
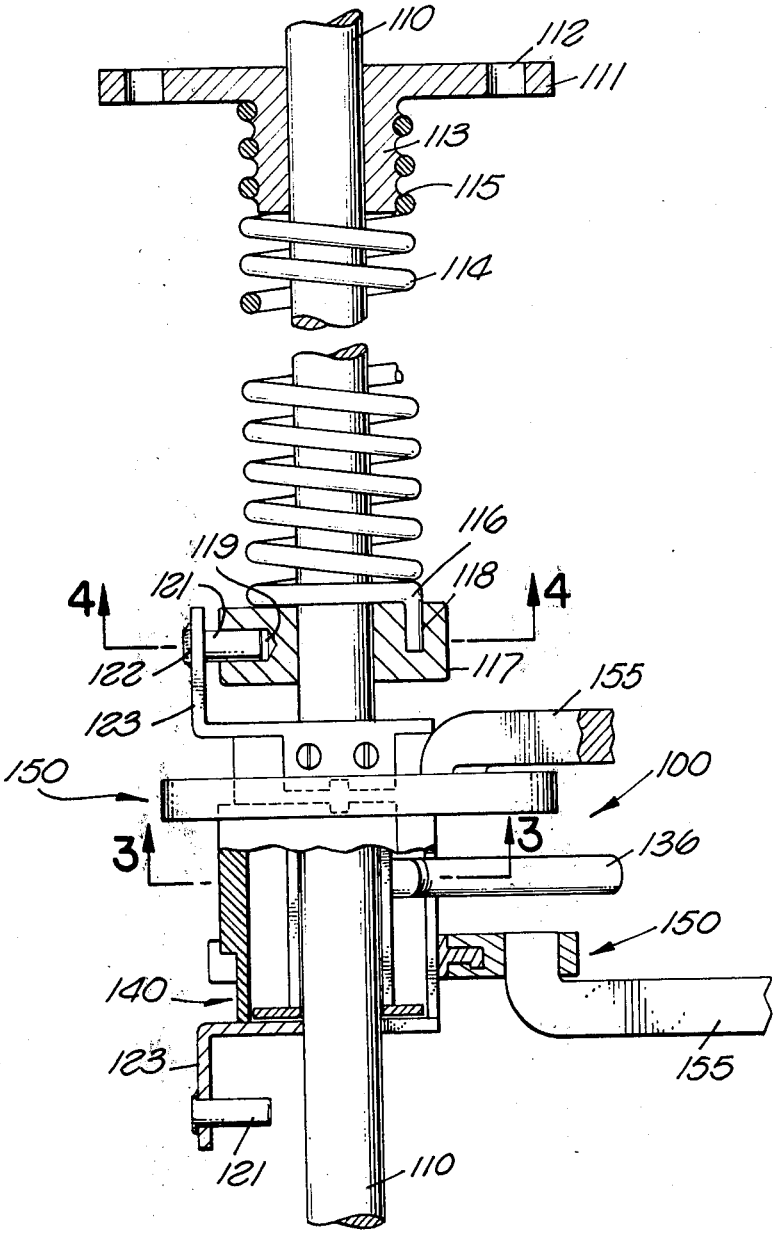
FIG. 2 is a section of a spring being wound in a manner similar to that shown in the prior art except with the use of a preferred embodiment of the invention of this application.

FIG. 2 illustrates a spring with its mounting flange and tensioning collar quite similar to that shown in FIG. 1. The difference is in the mechanism being utilized for tensioning.

In examining FIG. 2, it will be noted that a shaft 110 is inserted through a flange 111 having a shaped boss 113 which carries in its shaped portion 115 a few coils of spring 114. The flange has mounting holes 112.

The spring at its other end terminates in the bent end 116 which is inserted within hole 118 in the collar 117. The radial hole 119 in the circumference of the collar has had the pin 121 inserted in it. Pin 121 is carried by tab 123 and is riveted thereto by rivet head 122. The functioning of the tab 123 will be better understood when the entire remaining set of figures is viewed.

Continuing with the examination of FIG. 2, however, the ratchet tensioning apparatus of this invention, generally 100, is shown partially in section and assembled upon the shaft in operating position. A pair of ratchet devices 150, which will be explained in greater detail below, are seen fastened to collar and ratchet carrier 140, which will also be explained in greater detail below. Ratchet handles 155 are shown as well as the inner collar locking handle 136.

It will be observed that there are two pins 121 suitable to engage in a collar. In this manner, the device can operate on either a left-hand or a right-hand spring turning arrangement. As will be seen from the description below, the two ends of the device carrying the pins 121 are identical. In operation, the two handles 155 will be operated by the user for tensioning with the use of this device.

Figure 6:
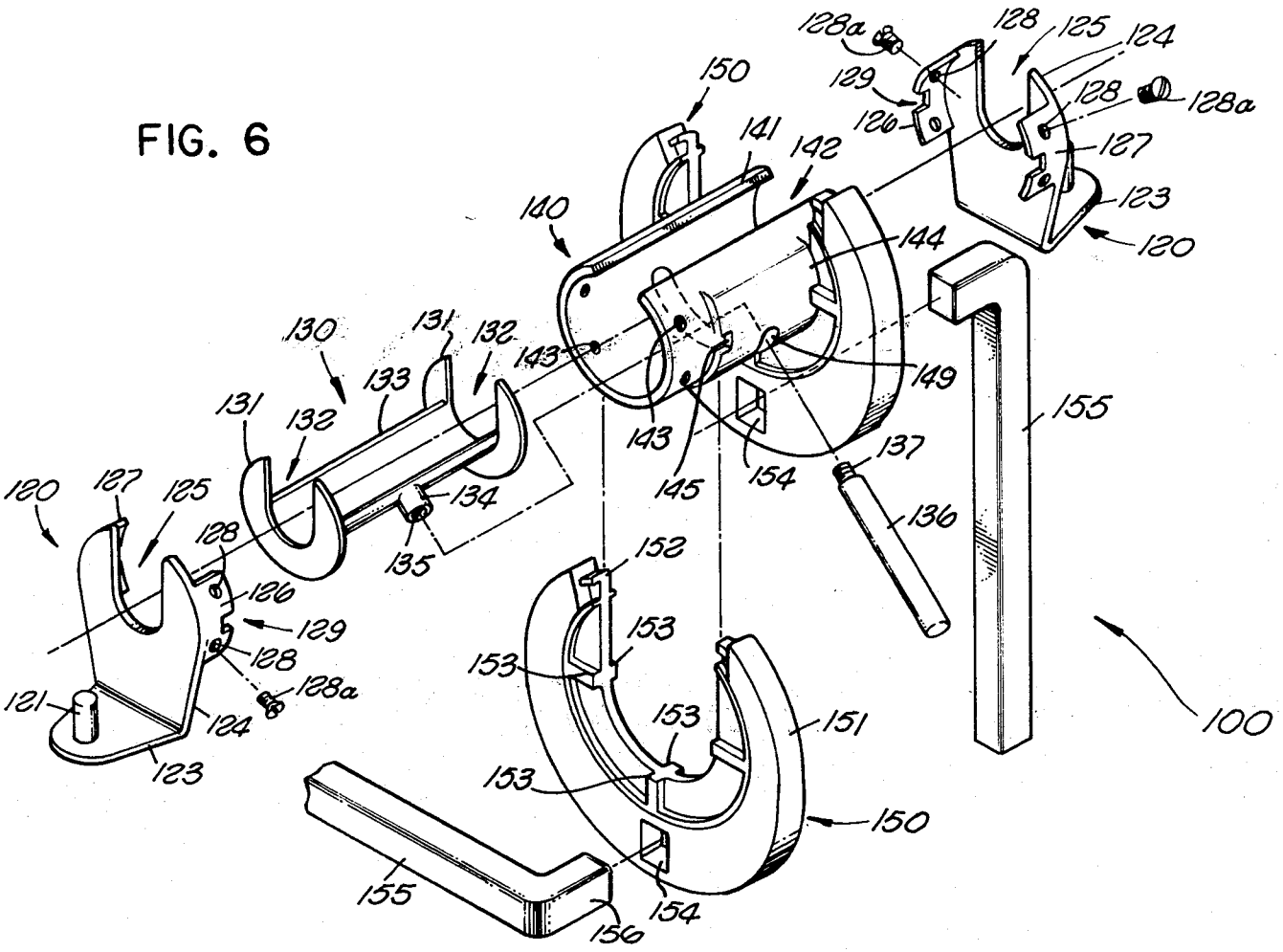
FIG. 6 is an exploded view of the apparatus being used in FIGS. 2, 3, 4, and 5.

At this point, it is desirable to examine all of the parts of the device as shown particularly well in FIG. 6. The device consists of two identical end pieces 120 comprising a tab 123 with pin 121 riveted or welded in place as shown. The tab 123 is perpendicularly attached to plate 124 which has mounting flange members 126 and 127 on each side. The plate member 124 has a generally U-shaped opening 125. The tabs 126 and 127 are provided with openings 129 which are utilized to grip the webs 153 on the ratchet mechanisms as will be explained below. The two end pieces are fastened by means of holes 128 and screws, or the like, **128*a***.

The inner collar, generally 130, comprises the two U-shaped end pieces 131 connected as illustrated by being manufactured in one piece or by welding or the like to the more or less semi-circular piece 131. A boss 134, having an internally threaded hole 135, is attached by welding or the like as illustrated.

When assembled, the inner portion 130 will be placed within the outer, partially tubular portion 140. This portion 140 has an enlarged center area 144, having openings 145 which will grip certain of the flanges 153, as will be clear and is partially illustrated wherein one of the flanges of the ratchet mechanism 150 is in place.

The handle 136 is threaded at 137 to engage within the threaded opening 135 for operation of the inner, segmented, tubular member, as will be further explained.

A slot 149 is provided in tubular member 141 through which the handle 136 is inserted into the threaded opening 135 when member 130 is placed within member 140.

The opening 142 in the partial tubular member 140 is sufficient to accommodate the shaft upon which the spring is wound. Likewise, the opening 132 serves a similar function upon the member 130.

Two ratchet mechanisms are held in place by means of gripping the web elements 153 between the openings 145 in the enlarged portion 144 of item 140 and the openings 129 on the end pieces. This will be understood by those skilled in the mechanical arts.

The end pieces are fastened in position by screws **128*a* inserted through holes 128 into threaded holes 143**.

The two ratchet mechanisms have openings as at 154 and handles 155 having a right angle bent end 156 for insertion within the holes 154 and for activation of the ratchets.

The particular ratchets utilized in the embodiment shown are ratchets described as Proto-Tac Model R-9440. They are described in literature of, and available from, Proto Tool Division of Ingersol Rand Company, 2600 East Nutwood Avenue, Fullerton, Calif. 92631. The ratchets may be obtained by specifying R-9440 - 2½ Proto-Tac Ratchets. Additionally, these ratchets are described in U.S. Pat. No. 2,578,686.

Figure 3:
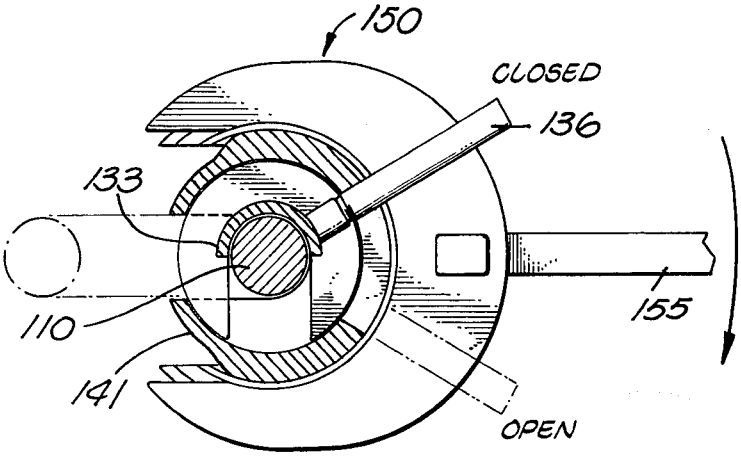
FIG. 3 is a partially sectioned view on 3—3 of FIG. 2.
Figure 4:
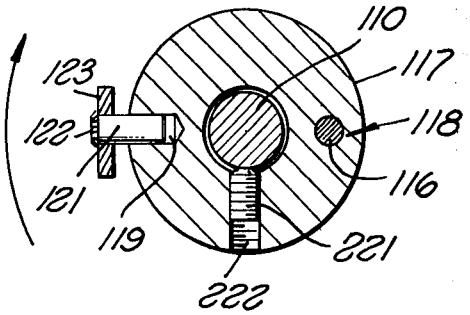
FIG. 4 is a section on 4—4 of FIG. 2.
Figure 5:
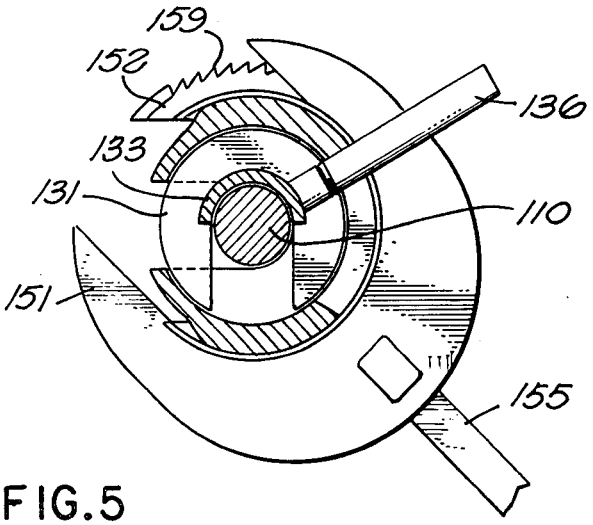
FIG. 5 is a view of the apparatus as shown in FIG. 3 except wherein the ratchet mechanism is being activated and, thus, certain elements are in a different circumferential location.

As is shown best in FIGS. 3, 4, and 5, the ratchet tooth portion 152, carrying teeth 159, is moveable within the housing 151. The tooth portion, of course, is carried upon the flange 152 and is held in position, as previously described, by the webs 153.

In operation, the entire assembled device, with the inner portion 130 having its openings in alignment with the openings in portion 140, will be slipped over the shaft 110. The handle 136 will then be moved in the slot 149 to the closed position shown in FIG. 3 and, thus, holds the device on the shaft. When it is slipped into position, one of the pegs 121 on the ends 120 will be inserted into the hole 119 in the collar. The set screw 121 will normally be loosened and, then, by alternate movement of the handles 155, the entire device will be rotated about the shaft, thus, tightening the collar.

FIG. 5 particularly shows one of the ratchets 150 having its housing 151 advanced to an operating position. At this point, the interior pawl will engage with some of the teeth 159 and, then, by pulling on handle 155, will advance the entire mechanism and will tighten the collar.

A number of modifications of one type or another may be made in this device. For example, it is even possible to have reversible ratchets. It is possible that the pin 121 could be spring loaded; the handle could be permanently affixed to the ratchet; and there could be springs of one type and another in the device to hold the inner tubular portion in locked position, as desired. There could be many modifications of this nature as will be clear, but they would not depart from the inventive concepts disclosed herein.

Although repetitive, for summary of the operation, it is to be observed that the entire mechanism as shown in FIG. 6, when assembled, will be slipped over a shaft as in the manner shown in FIG. 2. The pin 121 will be within the hole 119 in the collar. After being slipped over the shaft, the inner portion 130 will be rotated so that the shaft cannot slip out of the device and, then, the two handles 155 will be alternately worked back and forth. One handle will hold one of the ratchets while the other is being moved. Then, when the other has been advanced to a given point, the first handle will now again be moved and the second will be used for holding.

By this means it is very simple and safe to wind the spring. When the proper tension is achieved, the set screw in the collar is fastened tightly and, then, the inner portion is moved by means of the handle 136 to the point where the slots in both the inner and outer portions are aligned and the entire device is easily slipped from the shaft.

While the embodiment of this invention specifically shown and described is fully capable of achieving the objects and advantages desired, it is to be understood that such embodiment has been shown for purposes of illustration only and not for purposes of limitation.

I claim:

1. Apparatus for tensioning a coil spring, which spring is coiled around a shaft and includes collar means, comprising in combination:

(1) a first elongated collar means; (2) a second elongated collar means rotatably mounted within said first collar means; (3) alignable openings in both of said collar means such that in combination the two collar means may be slipped over a shaft; (4) means to rotate the two collar means with reference to one another in such manner that the openings do not align so as to allow removal from the shaft; (5) means connected to said first collar means suitable to operably engage with the collar means about said shaft and attached to said spring at one end; (6) ratchet means attached to said first collar means in such manner as to rotate said first collar means with reference to the said shaft and, thus, to rotate the second collar means and tension said spring; (7) means to hold said first collar means against reversal after having been moved by said ratchet means while said ratchet means is reset for further advancement; and (8) handle means suitable to activate said ratchet means.

2. The apparatus of claim 1 wherein the means to hold said collar means against reversal after being moved in one direction by said ratchet means is a second ratchet means.

3. The apparatus of claim 2 wherein each of said ratchet means acts as a means to rotate said first collar and also alternately as a means to hold said collar against reversal.

4. Apparatus for tensioning a coil spring having an end holding means comprising: a first elongated collar having an opening on one side suitable to slip onto a shaft; a second elongated collar rotatably mounted within said first elongated collar and having an opening alignable with the opening in said first collar; means connected to said second collar and operable from the exterior of said first collar suitable to rotate the said second collar in such manner that the openings in the two collars do not align; two end closure means fastened to said first collar, each of said end closure means having an opening in alignment with the opening in said collar; means suitable to connect to the spring end holding means mounted upon each of said end closure means; two ratchet means fixedly connected to said first collar means in such manner that the said first collar means, together with the second collar means and the two end closure means, may be advanced in a rotatable manner by alternate activation of the ratchet means.

* * * * *